US006928783B2

(12) United States Patent
Oliver et al.

(10) Patent No.: US 6,928,783 B2
(45) Date of Patent: Aug. 16, 2005

(54) FRAME CLAMP FOR ANCHOR STRAP

(76) Inventors: James Oliver, P.O. Box 9, Hohenwald, TN (US) 38462; Evon Oliver, P.O. Box 9, Hohenwald, TN (US) 38462; Scott E. Oliver, P.O. Box 9, Hohenwald, TN (US) 38462; Daniel L. Oliver, P.O. Box 9, Hohenwald, TN (US) 38462; John A. Oliver, P.O. Box 9, Hohenwald, TN (US) 38462

( * ) Notice: Subject to any disclaimer, the term of this patent is extended or adjusted under 35 U.S.C. 154(b) by 20 days.

(21) Appl. No.: 10/607,965

(22) Filed: Jun. 27, 2003

(65) Prior Publication Data

US 2004/0261330 A1 Dec. 30, 2004

(51) Int. Cl.[7] ..... E04B 1/38
(52) U.S. Cl. ..... 52/699; 52/149; 52/DIG. 11
(58) Field of Search ..... 24/489, 561, 298, 24/300, 301, 302, 265 H, 698.1, 698.2, 191, 311; 52/DIG. 11, 699, 148, 149, 151, 702, 698, 23, 169.1, 169.9, 293.3; 248/680, 681, 500, 505, 499, 503; 403/353

(56) References Cited

U.S. PATENT DOCUMENTS 3,845,597 A 11/1974 Foster
3,937,436 A 2/1976 Stewart
4,003,169 A 1/1977 Young
4,257,570 A 3/1981 Rasmussen
5,697,191 A 12/1997 MacKarvich
5,762,455 A 6/1998 Long
5,881,499 A 3/1999 Luzzi
5,983,573 A 11/1999 MacKarvich
6,058,663 A 5/2000 MacKarvich
6,176,056 B1 1/2001 MacKarvich
6,343,449 B1 2/2002 MacKarvich
6,415,572 B1 7/2002 MacKarvich
6,418,685 B1 7/2002 Oliver
6,607,246 B1 * 8/2003 Benden ..... 297/423.4

* cited by examiner

*Primary Examiner*—Naoko Slack
(74) *Attorney, Agent, or Firm*—Calif Tervo

(57) ABSTRACT

A frame clamp (40) for connecting a ground anchor strap (30) to I-beam (75) of manufactured home (70) includes top jaw (42), bottom jaw (52) and fastening means (60) therebetween. Top jaw (42) has engaging portion (47) on distal end (46) including arcuate bearing surface (49) for bearing against I-beam top flange distal edge (81) responsive to tension in anchor strap (30) such that clamp (40) aligns with anchor strap (30) when anchor strap (30) is not perpendicular to longitudinal axis (79) of flange distal edge (81). Strap (30) attaches to bottom jaw (52) which clamps clamp (40) to I-beam flange (76).

12 Claims, 2 Drawing Sheets

FIG. 6
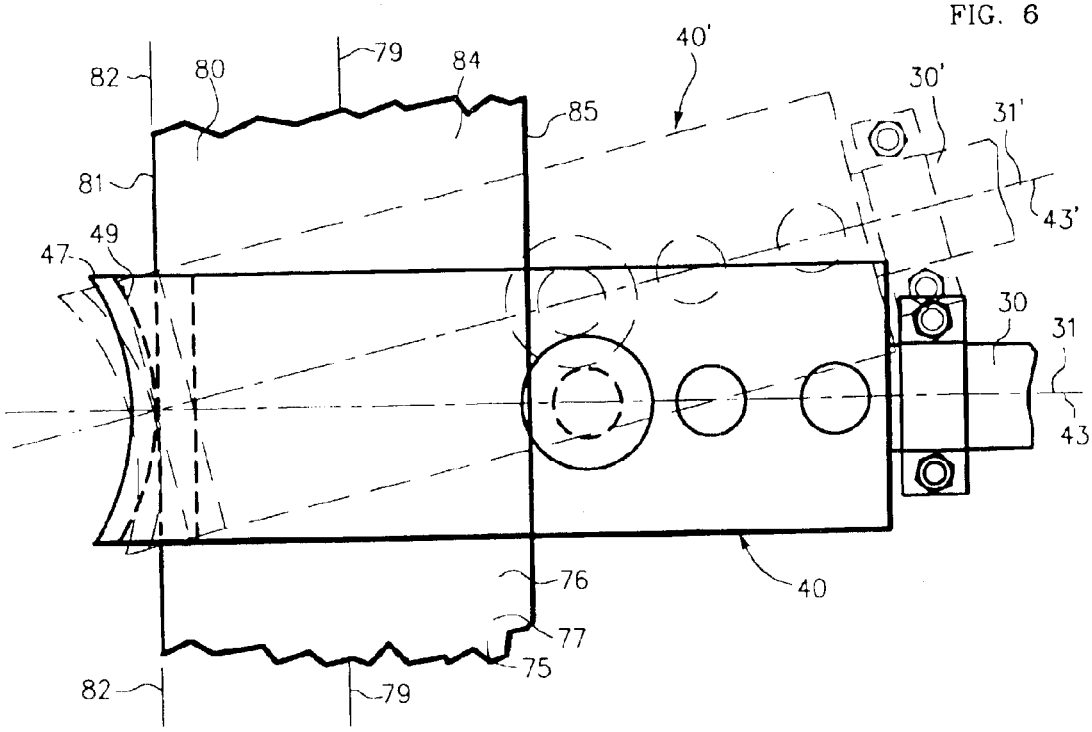
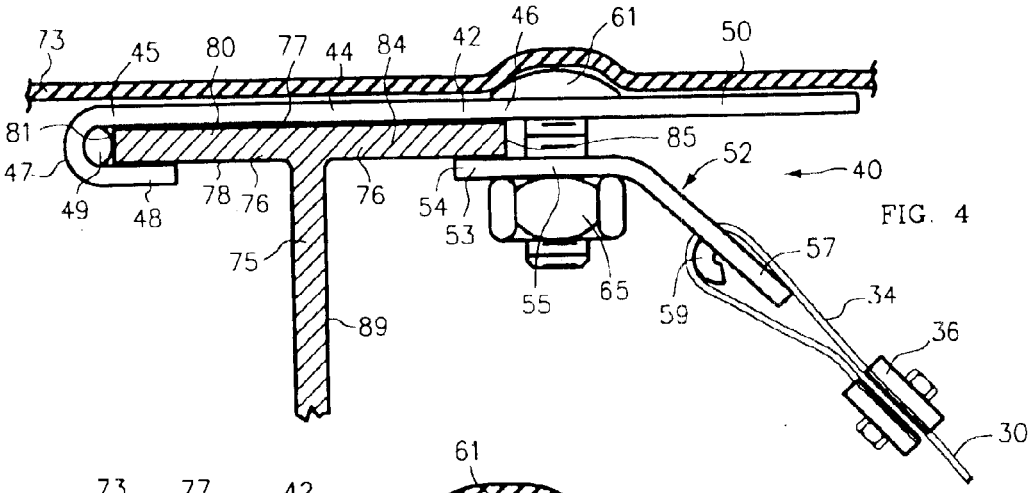
FIG. 4
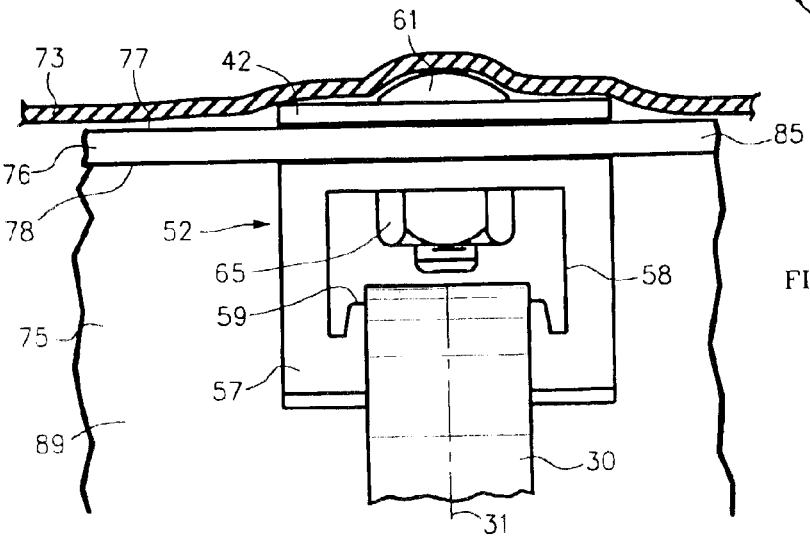
FIG. 5

FRAME CLAMP FOR ANCHOR STRAP

FIELD OF THE INVENTION

This invention relates in general to frame clamps for ground anchors for manufactured homes, and more specifically involves a frame clamp that aligns to an anchor strap that is non-perpendicular to the frame.

BACKGROUND OF THE INVENTION

Manufactured homes, such as mobile homes, trailers, and prefabricated homes are manufactured at a central manufacturing site and moved to the desired location where they are to be used. A typical manufactured home has a frame comprising a pair of longitudinal support beams that are supported at a height above the ground to allow for ventilation and crawl space. Typically the supports include piers such as concrete blocks, pilings, or stabilizing jacks.

However, strong winds or earth tremors can cause the home to be toppled from supports. Due to this risk, various types of stabilizing systems have been used for stabilizing manufactured homes on their piers. In the most common system, multiple tension straps are used to tether the manufactured home to the ground. In these systems, the tension straps typically extend perpendicularly outwardly from incremental positions along the length of the manufactured home's support beams. Usually, the tension straps extend downwardly from the support beams of the manufactured home frame to ground anchors, such as an auger and shaft, that are deeply embedded into the soil. Often, the tension straps are securely connected to the beams with strap connector assemblies that clamp or latch onto the support beams. Typically, a beam clamp includes a hook which receives an upper flange of the support beam. The tension straps usually are threaded through a strap slot formed in the clamp member. These strap slots normally are configured so as to be parallel to the hook and the longitudinal direction of the manufactured home, such that the tension straps can be positioned substantially perpendicularly to the longitudinal direction of the manufactured home.

Sometimes it is necessary or convenient to position a ground anchor such that the tension strap cannot be orientated perpendicular to the longitudinal direction of the I-beam of the home. For example, the ground anchor may already be in place and the home may include some obstruction such as a beam or plumbing, or a pier may be in the way, or it may not be possible to place the ground anchor in the desired location due to an obstruction such as an underground pipe or electrical conduits, or a large stone.

Conventional ground strap systems are not designed for non-perpendicular alignment with respect to the beam. Non-perpendicular alignment creates harmful stress concentrations in the tension strap or the clamp. A few ground anchor systems relieve stress from non-perpendicular strap alignment by pivoting about an axis perpendicular to the strap plane. However, these systems typically must be altered to accommodate different vertical strap angles.

Therefore, there has been a need for an anchor strap frame clamp that specifically provides for non-perpendicular orientation of the anchor strap to the beam and accommodates various vertical strap angles.

BRIEF DESCRIPTION OF THE DRAWINGS

FIG. 4 is left side elevation view of the clamp of FIG. 2 including an anchor strap and attached to a beam.

FIG. 5 is a front elevation view of FIG. 4

FIG. 6 is a top plan view of FIG. 4 additionally showing in phantom the clamp in non-perpendicular alignment with the beam.

DETAILED DESCRIPTION OF THE INVENTION

Figure 1:
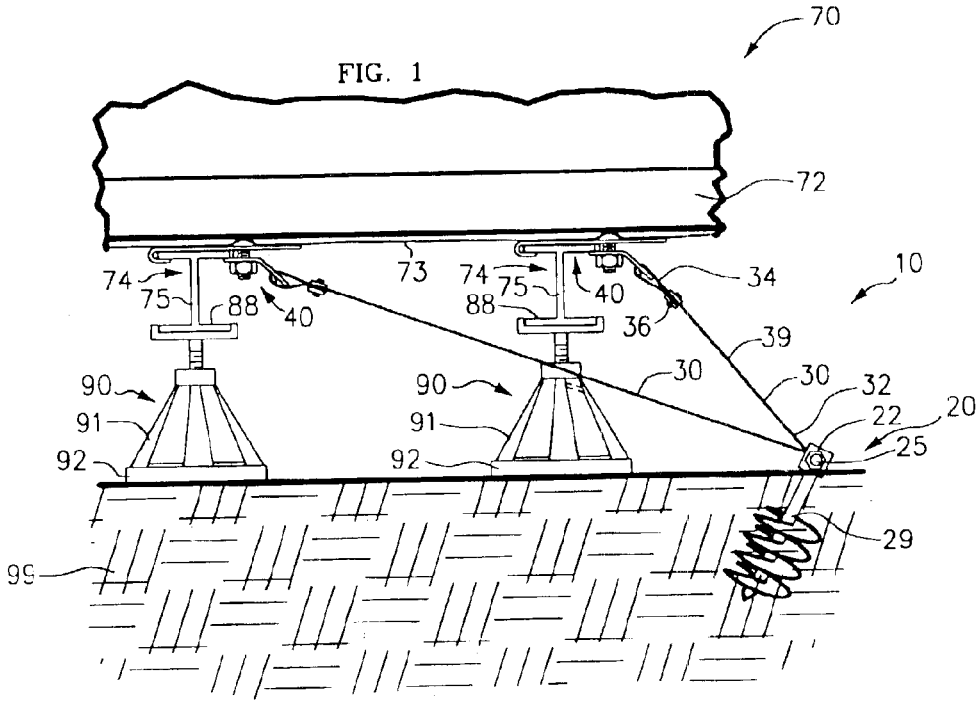
FIG. 1 is a left side elevation view of the frame clamp of the invention shown in use in stabilizing a manufactured home.
Figure 1:
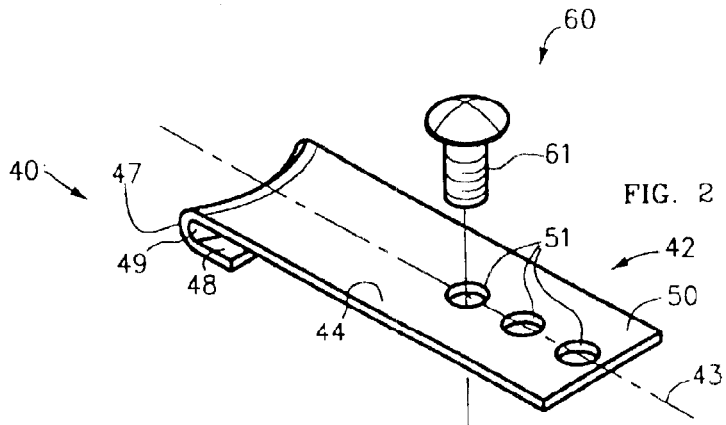

With reference now to the drawings, FIG. 1 is a left side elevation view of a preferred embodiment of the frame clamp 40 of the invention shown in use in stabilizing a manufactured home 70. The support frame of manufactured home 70 generally includes a plurality of spaced transverse floor joists 72. Bug seal or vapor barrier 73 is a thin layer of material that lies under floor joists 72 and covers the bottom of the manufactured home. Floor joists 72 and vapor barrier 73 are supported by multiple, typically two, longitudinal frame members 74, such as a beams having a medial web, such as a T-beam or I-beam 75. A plurality of supports 90 such as jacks or piers 91 are disposed along the length of I-Beams 75 for supporting home 70 a distance above the ground 99 such that there is a crawl space and ventilation under home 70. Foundations or foundation pads 92 support piers 91.

Figure 2:
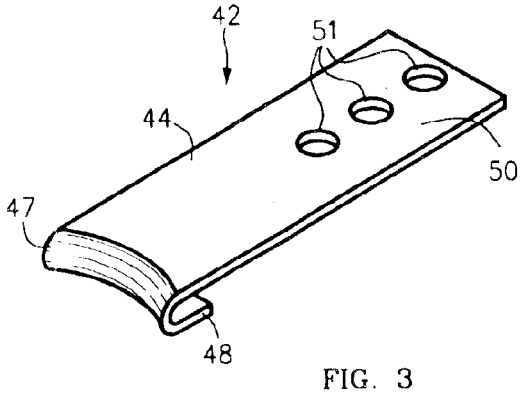
FIG. 2 is an exploded top, front, left side perspective view of a preferred embodiment of the frame clamp of the invention.

Looking also at FIG. 2 which is an exploded top, front, left side perspective view of a preferred embodiment of the frame clamp 40, anchor strap assembly 10 resists lateral forces on home 70. Anchor strap assembly 10 generally includes a ground anchor 20, an elongate anchor strap 30, and frame clamp 40. As best seen in FIG. 1, anchor strap assembly 10 may include one or more additional anchor straps 30 and clamps 40 attached to other beams 75. Ground anchor 20 may be of conventional design and includes an anchor head 22 disposed near the ground 99 to the side of beam 75. Anchor head 22 is attached to a retaining object, such as a foundation or anchor auger 29, so as to be fixed in position. Head 22 includes strap tensioning means such as one or more tensioning bolts 25, for tensioning anchor strap 30. Anchor strap 30 is of conventional design being an elongate, wide, solid flat metal strap, such as of high tension steel. Strap 30 has a bottom end 32, a top end 34, and a mid-section 39 therebetween. Top end 34 may be formed into a loop held by attachment means, such as a clamp 36, for attachment to clamp 40. Strap 30 has a length and width defining a strap plane and a longitudinal axis 31.

FIGS. 4, 5 and 6 show vapor barrier 73 and I-beam 75 in greater detail with FIG. 4 showing a transverse cross section, FIG. 5 showing a front elevation view, and FIG. 6 showing a top plan view. I-beam 75 includes a medial web, such as center web 89 joining a bottom flange 88 (FIG. 1) to top flange 76. Top flange 76 has a bottom side 78 and has a top side 77 that is generally planar and has a width between the edge 85 of proximal portion 84 of top flange 76 and edge 81 of distal portion 80 of top flange 76. Distal edge 81 has a longitudinal axis 82 that generally parallels the longitudinal axis 79 of beam 75.

Figure 3:
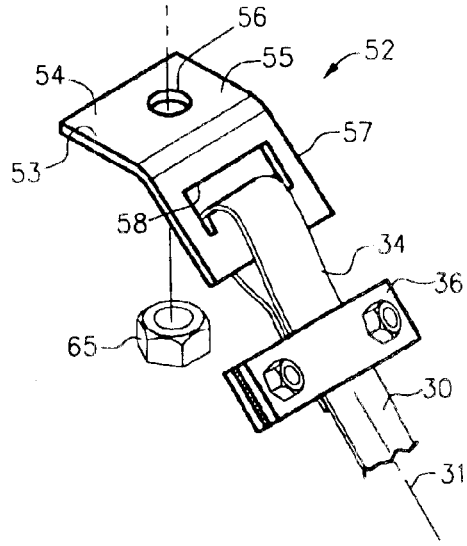
FIG. 3 is a top, rear, left side perspective view of the top jaw of the clamp of FIG. 2.

FIG. 2 is an exploded top, front, left side perspective view of a preferred embodiment of frame clamp 40 of the invention. FIG. 3 is a top, rear, left side perspective view of the top jaw 42 of the clamp of FIG. 2. Clamp 40 generally includes a top jaw 42, a bottom jaw 52, and fastening means 60, such as bolt 61 and nut 65, connecting them. Top jaw 42 is elongate and has a longitudinal axis 43. Top jaw 42 generally includes a central portion 44, an engaging portion 47, and a proximal portion 50. Central portion 44 is adapted for overlying top side 77 of top flange 76. Central portion 44 has a distal end 45 overlying distal edge 81 of top flange 76 and a proximal end 46 overlying proximal edge 85 of top flange 76. Engaging portion 47 is connected to central portion distal end 45 and projects downward and forward to so as to be J-shaped and include a underlying portion 48 underlying bottom side 78 of top flange 76 such that top jaw 42 cannot move directly upward off top flange 76.

Engaging portion 47 includes bearing surface means, such as arcuate bearing surface 49 that is convex relative to flange distal edge 81, for bearing against flange distal edge 81. The functioning of bearing surface 49 will be further explained later in this disclosure.

Proximal portion 50 of top jaw 42 is connected to proximal end 46 of central portion 44 and projects forward, cantilevered from top flange 76. Proximal portion 50 includes adjustment means, such as a plurality of longitudinally spaced bores 51 for receiving bolt 61, for adjusting the distance between bolt 61 and bearing surface 49 such that clamp 42 may clamp to top flanges 76 of various widths.

Bottom jaw 52 generally comprises a gripping portion 53, a connecting portion 57, and a fastening portion 55 joining them. Gripping portion 53 includes a contact area 54 for contacting bottom side 78 of top flange 76 opposite central portion 44. Connecting portion 57 includes attaching means, such as thru slot 58, for attaching top end 34 of anchor strap 30 to bottom jaw 52. Preferably, the attaching means is adapted so as to not induce high stress risers on strap 30 so as to cause strap 30 to tear. To this end, slot 58 includes a radiused surface 59, around which strap 30 is run for applying tension to strap 30. Fastening portion 55 includes means, such as bore 56 for receiving bolt 61, for fastening bottom jaw 52 to top jaw 42. Bolt 61 is tightened to clamp top flange 76 between contact area 54 of bottom jaw 52 and central portion 44 of top jaw 42 such that jaws 42, 52 grip flange 76.

FIG. 6 is a top plan view of FIG. 4 additionally showing in phantom clamp 40' in non-perpendicular alignment with I-beam 75. Arcuate bearing surface 49 is convex relative to flange distal edge 81 and, responsive to tension in anchor strap 30, pivots top jaw 42 into alignment with anchor strap 30 when anchor strap 30 is not perpendicular to longitudinal axis 82 of flange distal edge 81. That is, in top view, longitudinal axis 43 of top jaw 42 aligns with longitudinal axis 31 of anchor strap 30. In FIG. 6, pivoted clamp 40' has longitudinal axis 43' aligned with longitudinal axis 31' of non-perpendicular strap 30'. Although a large radius arcuate bearing surface 49 is shown, the bearing surface could take other forms, such as having a much smaller radius.

As best seen in FIGS. 4 and 5, in use, top jaw 42 is mounted on I-beam 75 by passing J-shaped engaging portion 47 over I-beam 75, typically between two floor joists 72. The curved end and low profile of engaging portion 47 slide under vapor barrier 73. Bolt 61 can be pre-inserted in bore 51 if vapor barrier 73 is taut, or inserted later if desired and vapor barrier is loose. Strap 30 is attached to bottom jaw 52 and partially tensioned to align clamp 40. Nut 65 is turned to clamp jaws 42, 52 on beam 75. Strap 30 is tensioned.

Clamp 40 aligns with strap 30 regardless of the vertical angle of strap 30. Thus, clamp 40 can be used on the near I-beam 75, which typically requires about a 60 degree vertical strap angle, or the far I-beam 75, which typically requires about a 15 degree vertical strap angle.

From the foregoing description, it is seen that the present invention provides an extremely simple, efficient, and reliable clamp for preventing stress concentration in anchor straps.

Although a particular embodiment of the invention has been illustrated and described, various changes may be made in the form, composition, construction, and arrangement of the parts herein without sacrificing any of its advantages. Therefore, it is to be understood that all matter herein is to be interpreted as illustrative and not in any limiting sense, and it is intended to cover in the appended claims such modifications as come within the true spirit and scope of the invention.

We claim:

1. A clamp for attaching an elongate anchor strap to a frame component having a top side having a width, a bottom side, a distal edge having a longitudinal axis, and a proximal edge; said clamp comprising:

a top jaw comprising:

a central portion adapted for overlying the top side of the frame component; said central portion including:

a distal end; and a proximal end;

an engaging portion connected to said central portion distal end and projecting downward from said central portion including:

bearing surface means for bearing against the frame component distal edge responsive to anchor strap tension such that said top jaw aligns with the anchor strap when the anchor strap is not perpendicular to the longitudinal axis of the frame component distal edge; and a proximal portion connected to said central portion; and a bottom jaw comprising:

a gripping portion including:

a contact area for contacting said bottom side of the frame component opposite said central portion; and a connecting portion including:

attaching means for attaching the anchor strap; and fastening means for fastening said bottom jaw to said proximal portion of said top jaw such that said jaws grip the frame component.

2. The clamp of claim 1 wherein:

said fastening means includes:

a fastener between said bottom jaw and said proximal portion of said top jaw; and wherein: said proximal portion of said top jaw includes:

adjustment means for adjusting the distance between said fastener and said bearing surface such that said clamp may clamp to frame component top sides of various widths.

3. The clamp of claim 1 wherein:

said engaging portion includes:

an underlying portion for underlying the bottom side of the frame component such that said top jaw cannot be removed directly upward.

4. The clamp of claim 1 wherein:

said bearing surface means of said top jaw comprises:

an arcuate bearing surface that is convex relative to the frame component distal edge.

5. A clamp for attaching an elongate anchor strap to a support beam of a manufactured home supported above the ground from an anchor head disposed near the ground to the side of the beam; the support beam including: a top flange including: a top side having a width; a bottom side; a distal edge; and a proximal edge; said clamp including:

a top jaw comprising:

a central portion adapted for overlying the top side of the top flange; said central portion including:

a distal end; and a proximal end;

an engaging portion connected to said central portion distal end and projecting downward from said central portion including:

bearing surface means for bearing against the flange distal edge responsive to anchor strap tension such that said top jaw aligns with the anchor strap when the anchor strap is not perpendicular to the longitudinal axis of the flange distal edge; and a proximal portion connected to said central portion; and a bottom jaw comprising:

a gripping portion including:

a contact area for contacting said bottom side of the flange opposite said central portion; and a connecting portion including:

attaching means for attaching the anchor strap; and fastening means for fastening said bottom jaw to proximal portion of said top jaw such that said jaws grip the flange.

6. The clamp of claim 5 wherein:

said fastening means includes:

a fastener between said bottom jaw and said proximal portion of said top jaw; and wherein:

said proximal portion of said top jaw includes:

adjustment means for adjusting the distance between said fastener and said bearing surface such that said clamp may clamp to flange top sides of various widths.

7. The clamp of claim 5 wherein:

said engaging portion includes:

an underlying portion for underlying the bottom side of the flange such that said top jaw cannot be removed directly upward.

8. The clamp of claim 5 wherein:

said bearing surface means comprises:

an arcuate bearing surface that is convex relative to the flange distal edge.

9. In combination:

a manufactured home including:

a support beam including:

a medial web; and a top flange connected to said web including:

a top side having a width;

a bottom side;

a distal edge having a longitudinal axis; and a proximal edge;

supports supporting said home above the ground;

an anchor strap assembly including:

an elongate anchor strap including:

a bottom end; and a top end;

an anchor head disposed near the ground to the side of said beam; said anchor head connected to said bottom end of said anchor strap; and a clamp including:

a top jaw comprising:

a central portion adapted for overlying said top side of said top flange, said central portion including:

a distal end; and a proximal end;

an engaging portion connected to said central portion distal end and projecting downward from said central portion including:

bearing surface means for bearing against said flange distal edge responsive to tension in said anchor strap such that said top jaw aligns with said anchor strap when said anchor strap is not perpendicular to the longitudinal axis of said flange distal edge; and a proximal portion connected to said central portion; and a bottom jaw comprising:

a gripping portion including:

a contact area for contacting said bottom side of said flange opposite said central portion; and a connecting portion including:

attaching means fastening said top end of said anchor strap to said clamp; and fastening means fastening said bottom jaw to proximal portion of said top jaw such that said jaws grip said flange.

10. The combination of claim 9 wherein:

said fastening means includes:

a fastener between said bottom jaw and said proximal portion of said top jaw; and wherein:

said proximal portion of said top jaw includes:

adjustment means for adjusting the distance between said fastener and said bearing surface such that said clamp may clamp to flange top sides of various widths.

11. The combination of claim 9 wherein:

said engaging portion includes:

an underlying portion for underlying the bottom side of said flange such that said top jaw cannot be removed directly upward.

12. The combination of claim 9 wherein:

said bearing surface of said top jaw comprises:

an arcuate bearing surface that is convex relative to said flange distal edge.

* * * * *